US005778794A

United States Patent [19]

Theurer et al.

[11] Patent Number: 5,778,794

[45] Date of Patent: Jul. 14, 1998

[54] MACHINE FOR LAYING A RAILROAD TRACK HAVING MULTIPLE-PART CARRIER FRAME CONNECTED BY A DISENGAGEABLE JOINT

[75] Inventors: Josef Theurer, Vienna; Manfred Brunninger, Altenberg, both of Austria

[73] Assignee: Franz Plasser Bahnbaumaschinen-Industriegesellschaft M.B.H., Vienna, Austria

[21] Appl. No.: 865,233

[22] Filed: May 29, 1997

[30] Foreign Application Priority Data

Jun. 4, 1996 [AT] Austria ..... 967/96

[51] Int. Cl.[6] ..... E01B 29/00

[52] U.S. Cl. ..... 104/2; 104/6

[58] Field of Search ..... 104/2, 5, 6, 7.1

[56] References Cited

U.S. PATENT DOCUMENTS

| | | | |
|---|---|---|---|
| 3,604,358 | 9/1971 | Plasser et al. | 104/6 |
| 4,236,452 | 12/1980 | Theurer et al. | 104/2 |
| 4,643,100 | 2/1987 | Valditerra | 104/2 |
| 4,867,068 | 9/1989 | Valditerra | 104/2 |
| 4,979,247 | 12/1990 | Buhler | 104/5 |
| 5,357,867 | 10/1994 | Theurer et al. | 104/2 |

*Primary Examiner*—S. Joseph Morano
*Attorney, Agent, or Firm*—Henry M. Feiereisen

[57] ABSTRACT

A machine for continuously laying a track comprised of two rails fastened to ties includes a machine frame having a first carrier frame and a second carrier frame which are supported successively in longitudinal direction of the machine frame on undercarriages for mobility on the track in an operating direction. A joint so detachably connects the first and second carrier frames to one another that the second carrier frame is positioned above the first carrier frame in an area of the joint and movable relative thereto in longitudinal direction of the machine frame. The first carrier frame is provided with a railway track for mobility of a tie transport device that continuously transports ties in longitudinal direction of the machine frame and includes a mobile crane. The second carrier frame is provided in the area of the joint with an auxiliary vertically adjustable undercarriage for mobility on the railway track of the first carrier frame.

10 Claims, 2 Drawing Sheets

MACHINE FOR LAYING A RAILROAD TRACK HAVING MULTIPLE-PART CARRIER FRAME CONNECTED BY A DISENGAGEABLE JOINT

BACKGROUND OF THE INVENTION

The present invention refers to a machine for continuously laying a railroad track which is formed of rails fastened by ties and is supported on a ballast bed. More particularly, the present invention is directed to a track laying machine of a type having a first carrier frame and a second carrier frame arranged sequentially in longitudinal direction of the machine frame in operative position and supported by undercarriages for mobility in an operating direction, a joint for connecting the two carrier frames to one another, with the second carrier frame being positioned in the area of the joint above the first carrier frame and movable relative thereto in longitudinal direction of the machine frame, and with the second carrier frame having a joint-distal end which is provided with an off-track undercarriage, and a tie transport device for effecting a continuous transport of ties in longitudinal direction of the machine frame, with the tie transport device including a mobile crane traveling on the first carrier frame along a railway track.

U.S. Pat. No. 3,604,358 discloses a track laying machine of this type for continuously laying ties of a track on a ballast bed and/or taking up old ties when operating the machine in opposite direction. One of the two carrier frames is supported on undercarriages which travel on the rails of the railroad track. At the job site, the rails of the railroad track are lifted in the area of the tie laying zone for creating a work space and spread onto the newly deposited ties ahead of the leading undercarriage of the machine. The second carrier frame extending also in longitudinal direction of the machine has one end articulated to the first carrier frame while the other, free end is provided with an off-track undercarriage for traveling on the tie-less ballast bed during track renewal operation. The connection of the two carrier frames extend sequentially in longitudinal direction of the machine frame during track renewal operation is effected by a joint via which the second carrier frame is articulated to an intermediate frame which is movably supported via rollers on the first carrier frame in longitudinal direction of the machine frame. The supply of ties to the job site is carried out by a tie transport device which has a crane traveling on the first carrier frame and delivers the ties in the area of the joint onto a conveyor unit. The conveyor unit includes a conveyor belt arranged on the second carrier frame for advancing the ties in longitudinal direction of the machine frame to the tie laying device which is situated in the area of the off-track undercarriage.

During travel to the job site, the second carrier frame of the machine can be shifted relative to the first carrier frame in longitudinal direction of the machine frame and partially moved toward the end of the first carrier frame that forms a flat car or farther inwardly, with the end section of the second carrier frame, supporting the tie laying device, jutting outwardly from the flat car in longitudinal direction of the machine frame.

U.S. Pat. No. 5,357,867 discloses a machine for renewing or laying a railroad track, including a machine frame in form of two carrier frames supported on undercarriages and so connected together by a joint as to exhibit a superimposed disposition in the area of the joint. The machine is suitable for laying a new track and simultaneous removal of the old track. The carrier frame supporting the work aggregates is equipped at its joint-distal end in addition to the undercarriage with a vertically adjustable, off-track undercarriage which travels between a device for receiving old ties and a device for laying new ties on the exposed ballast bed. A gantry crane traveling on the machine frame in longitudinal direction of the machine frame runs back and forth along a continuous railway track to remove old ties and to deliver new ties in conjunction with a conveyor belt. A vertically adjustable auxiliary undercarriage is further provided to effect a temporary support of the one carrier frame in the area of the off-track undercarriage after conclusion of the operation.

U.S. Pat. No. 4,979,247 discloses a railroad track renewal train formed by a machine frame having two carrier frames shiftable relative to one another in longitudinal direction of the machine frame. One carrier frame is supported by undercarriages and, during renewal operation, one end thereof is supported by caterpillar tracks, while the other carrier frame forms a laying unit which in its entirety is loaded onto the first carrier frame during travel from one job site to another job site. During renewal operation, one end of the second carrier frame rests on the first carrier frame, and the other free end rests on the newly laid track via a vertically adjustable undercarriage.

SUMMARY OF THE INVENTION

It is thus an object of the present invention to provide an improved machine for laying a railroad track, which can be rapidly readied with a minimum of adjustment work for use in a track renewal operation and for travel to a new job site.

This objects, and others which will become apparent hereinafter are attained in accordance with the present invention by providing a machine frame having a first carrier frame and a second carrier frame which are detachably connected to one another via a joint, with the second carrier frame being movable relative the first carrier frame in longitudinal direction of the machine frame and being provided with an off-track undercarriage, and a tie transport device in the form of a mobile crane traveling on a railway track formed on the first carrier frame, and by providing the second carrier frame in the area of the joint with an auxiliary undercarriage which is movable on the railway track of the first carrier frame and vertically adjustable by a suitable drive unit.

In accordance with the present invention, the already existing railway track for the mobile crane on the first carrier frame is utilized not only to precisely and securely guide the second carrier frame for a rapid adaptation between a loading position and an operative position. As the installation of the auxiliary undercarriage requires only a minimum of additional equipment, the transport of rails and ties between both carrier frames during renewal operation is not adversely affected in any way. In particular, no additional adjustments or retrofitting works are required.

Preferably, the auxiliary undercarriage is swingably mounted to the second carrier frame about a horizontal axis extending perpendicular to the longitudinal direction of the machine frame and is connected to the drive unit which is suitably configured in the form of a pivot drive.

According to another feature of the present invention, the second carrier frame is further supported by two additional auxiliary track-bound undercarriages which are vertically adjustable and positioned respectively on each side of the off-track undercarriage, whereby at least one of the two auxiliary undercarriages is operated by a separate drive.

Suitably, the railway track of the first carrier frame for mobility of the crane is extended by an aligned railway track of the second carrier frame when the machine frame is positioned at a job site for executing the renewal operation of the railroad track.

According to yet another feature of the present invention, the tie transport device includes a conveyor belt positioned in an area of the second carrier frame in longitudinal direction of the machine frame, wherein the conveyor belt is suitably arranged in an area of the second railway track above a horizontal plane defined by the second carrier frame for formation of a tie transfer area.

According to still another feature of the present invention, a tie laying device is mounted to the second carrier frame in an area of the off-track undercarriage for depositing ties upon the ballast bed, with the tie laying device cooperating with a leading end of the conveyor belt.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
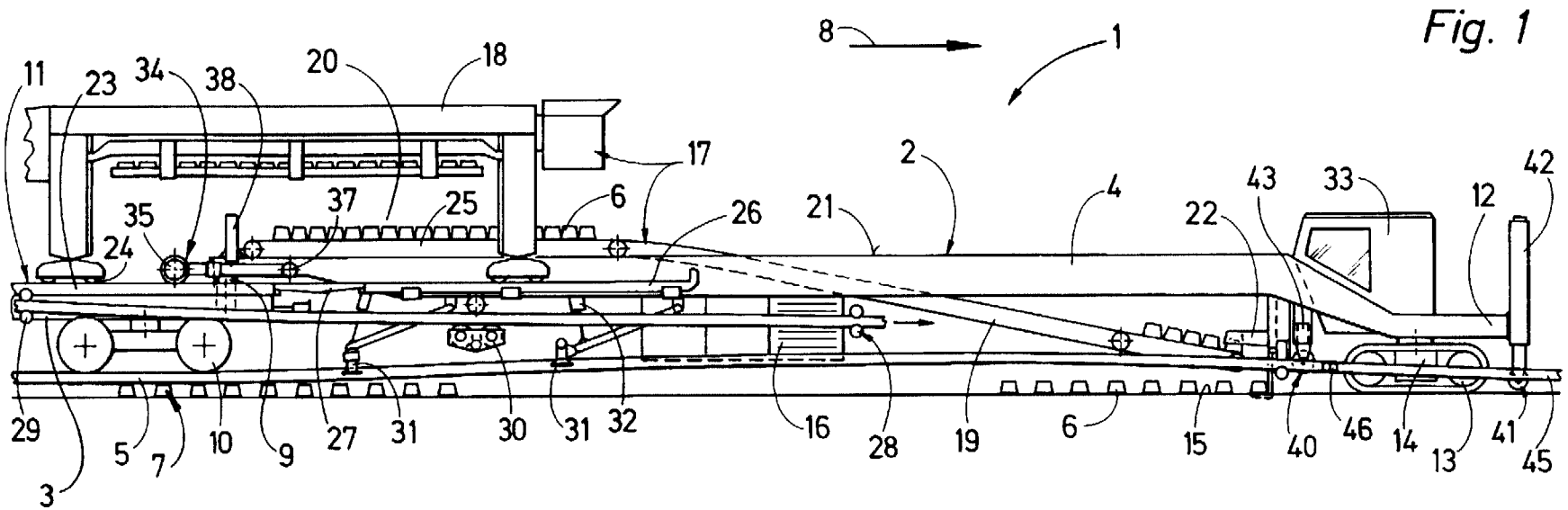
FIG. 1 is a side elevational view of a track laying machine in accordance with the present invention, illustrating the track laying machine in its track renewal mode.

Throughout all the Figures, the same or corresponding elements are always indicated by the same reference numerals.

Figure 2:
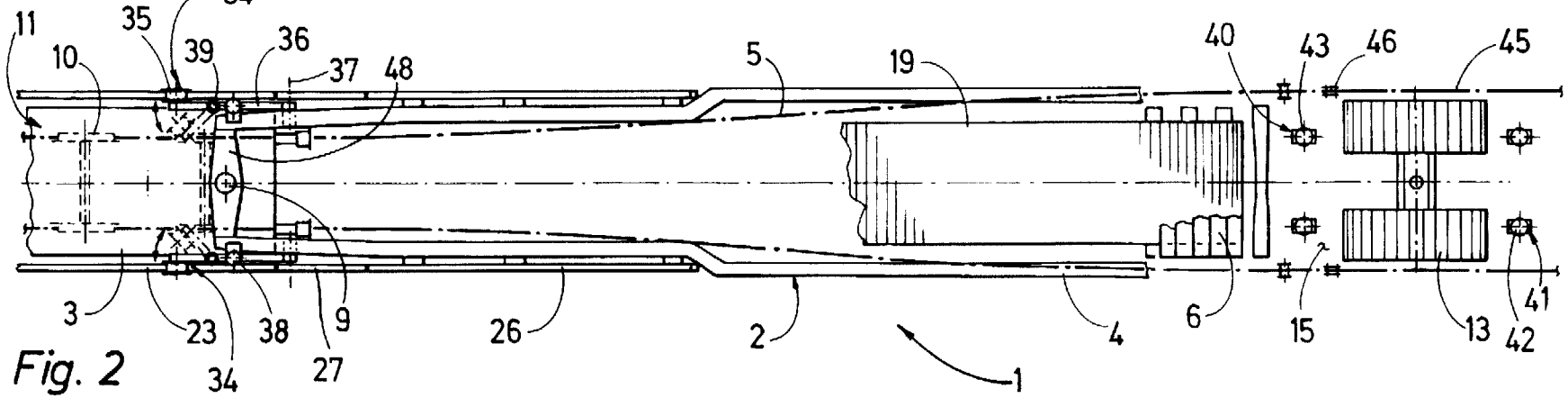
FIG. 2 is a greatly simplified plan view of the track laying machine of FIG. 1.

Turning now to the drawing, and in particular to FIG. 1, there is shown a side elevational view of a railroad track laying machine according to the present invention, generally designated by reference numeral 1 and including an elongated machine frame, generally designated by reference numeral 2 and comprised of two carrier frames 3, 4 for continuously laying a track 7, formed by rails 5 and ties 6, in an operating direction, indicated by arrow 8. In the track renewal mode, as illustrated in FIG. 1, the carrier frames 3, 4 are arranged sequentially to one another in longitudinal direction of the machine frame 2 and detachably connected together by a disengageable joint, generally designated by reference numeral 9. In the nonlimiting example of FIG. 1, the joint 9 is formed by a vertical post 47 that extends upright from the first carrier frame 3 and is engageable through a complementary opening in a crosspiece 48 of the second carrier frame 4, as shown in FIG. 2. The trailing first carrier frame 3, as viewed in traveling direction and illustrated only partially, is supported by undercarriages 10 (only one is shown) and forms a flatbed car 11 which can be linked to other similar flatbed cars to a train formation. In the operative position, shown in FIG. 1, the second carrier frame 4 is supported on one end by the first carrier frame 3 in the area of the joint 9 in superimposed disposition while the other joint-distal free end 12 of the carrier frame 4 has mounted thereon an off-track undercarriage 13 that is operated by a separate drive 14. The off-track undercarriage 13 is capable of traveling on the exposed ballast bed 15 of the railroad track 7 and activated by a motor 16.

The track laying machine 1 is equipped with a tie transport device 17 for effecting a continuous transport of ties 6 in longitudinal direction of the machine frame 2. The tie transport device 17 is generally comprised of a mobile crane 18 and a conveyor belt 19 which is mounted on the second carrier frame 4 and extends in longitudinal direction of the machine frame 2 to form with its trailing section 25, as viewed in operating direction indicated by arrow 8, a tie transfer zone 20 that is positioned above a plane 21 defined by the second carrier frame 4. The conveyor belt 19 has a leading end, as viewed in operating direction 8, which interacts with a tie laying device 22 which is disposed in an area of the second carrier frame 4 in proximity of the off-track undercarriage 13 and effects a deposit of the ties 6 on the ballast bed 15.

The mobile crane 18 is designed as gantry crane and runs on rollers 24 for mobility in longitudinal direction on a railway track 23 of the machine 1. The railway track 23 extends along the first carrier frame 3 or flatbed car 11 and is continued on a flatbed car (not shown) linked thereto. In the area of the tie transfer zone 20, the frame section 25 of the second carrier frame 4 in vicinity of the joint 9 is also provided with a railway track 26 which, in operative position of the machine 1, extends at a same level as the railway track 23 of the first carrier frame 3. Connection pieces 27 are provided between the railway tracks 23 and 26 to bridge any formed gaps therebetween. Thus, the mobile crane 18 can travel unhindered along the train formation between (not shown) tie transport cars and the tie transfer zone 20.

Further provided on the carrier frames 3, 4 in longitudinal direction of the machine frame 2 are spaced-apart rail transport devices 28 in the form of guide rollers 29, and a traction device 30 for effecting a continuous transport of the rails 5 in longitudinal direction of the machine frame 2. During transport, the separate rail sections are connected together by rail fasteners such as fish plates to form a continuous long rail which is so advanced during track laying operation until a fishplate connection is positioned in an area of the joint-distal end 12 of the second carrier frame 4. By means of a not shown device for lowering the rails 5, the leading rail, denoted by reference numeral 45, is deposited after loosening of the fishplate and connected by a fishplate 46 with the free end of the rail 5 that has been deposited on the newly laid ties 6. Rail guide devices 31 which are adjustable in vertical direction and sideways by drives 32 are mounted to the second carrier frame 4 for effecting a laying and spreading of the rails 5 at the desired track gage on the ties 6.

At its joint-distal end 12, the second carrier frame 4 supports a tie laying device 22 and an operator's cab 33 for monitoring operation of the tie laying device 22.

The second carrier frame 4 which during track renewal operation is temporarily connected to the first carrier frame 3 by the joint 9 is movable in longitudinal direction of the machine frame 2 relative to the first carrier frame 3 and is equipped in the area of the joint 9 with an auxiliary undercarriage 34 substantially in the form of two flanged rollers 35 spaced from one another transversely to the machine frame 2, as shown in particular in FIG. 2. The flanged rollers 35 of the undercarriage 34 travel on the railway track 23 of the first carrier frame 3 and are swingably mounted to the second carrier frame 4 of the machine frame 2 for pivoting about a horizontal axis 37 extending perpendicular to the longitudinal direction of the machine frame 2, with a pivot drive 38 effecting the operation of the auxiliary undercarriage 34. A further drive 39 effects an adjustment of the flanged rollers 35 relative to one another in a direction transversely to the machine frame 2. Arranged additionally on the free end 12 of the second carrier frame 4 are two auxiliary undercarriages 40, 41 which, as shown in FIG. 2, are arranged, as viewed in longitudinal direction of the machine frame 2, on both sides of the off-track undercarriage 13 and adjustable in a vertical direction by drives 42. The gage of the auxiliary undercarriages 40, 41 corresponds to the gage of the undercarriages 10, with the auxiliary undercarriages 40, 41 supporting the second carrier frame 4 on the track 7, as will be described further below. A drive for advancing the auxiliary undercarriage 40 is denoted by reference numeral 43.

The various stages to convert and ready the track laying machine 1 for track renewal operation will now be described with reference to FIGS. 3 to 7.

Figure 3:
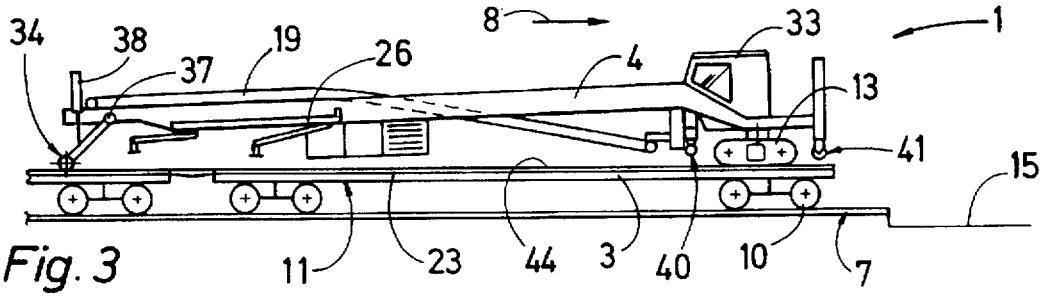
FIGS. 3 to 7 show schematic side views, on a smaller scale, of the track laying machine, illustrating various successive stages for converting the track laying machine to a configuration suitable for commencing a track renewal operation.

In FIG. 3, the track laying machine 1 is in transit and travels to the job site. The second carrier frame 4 is completely positioned on the flatbed car 11 as formed by the first carrier frame 3 and is supported on one end by the off-track undercarriage 13 on a loading deck 44 of the flatbed car 11. The other end of the second carrier frame 4 is supported by the lowered auxiliary undercarriage 34 upon the railway track 23. The auxiliary undercarriages 40, 41 are raised into their idle or inoperative position. In the nonlimiting example of FIG. 3, the job site has a prepared trackless ballast bed 15 that continues an already laid track 7 on which the track laying machine 1 advances.

Figure 4:
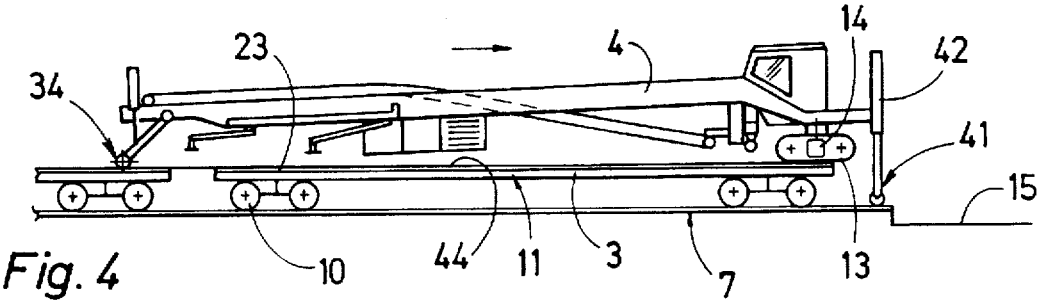
Figure 5:
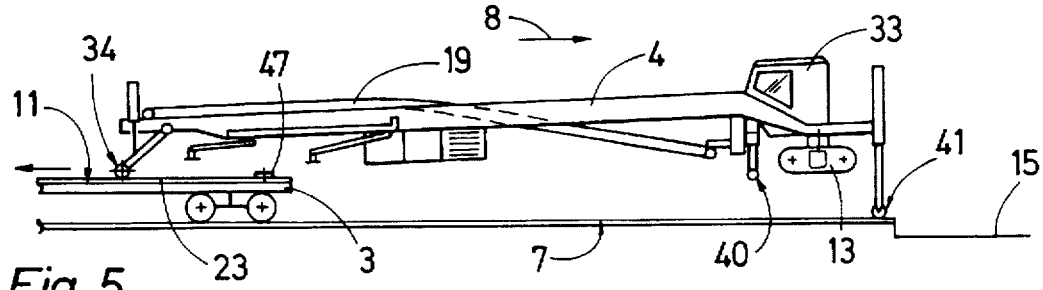

Upon reaching the job site, the second carrier frame 4 is advanced by the drive 14 in operating direction, indicated by arrow 8 until the auxiliary undercarriage 41 is positioned beyond the end of the first carrier frame 3 or flatbed car 11, as shown in FIG. 4. The drive 42 is activated to lower the auxiliary undercarriage 41 onto the track 7 and thereby to support the second carrier frame 4 on the track 7 in immediate proximity to the job site. At the same time, the off-track undercarriage 13 is raised from the loading deck 44. The trailing end of the second carrier frame 4 is continued to be supported by the auxiliary undercarriage 34 on the railway track 23. Then, as shown in FIG. 5, the train formation is moved in a direction opposite to the operating direction indicated by arrow 8 so that the flatbed car 11 is pulled almost completely out from under the stationary second carrier frame 4. Persons skilled in the art will understand that during this displacement of the flatbed car 11, the auxiliary undercarriage 41 must be locked in place on the track 7 through suitable mean e.g. incorporation of a brake, while the auxiliary undercarriage 34 travels along the railway track 23. For sake of simplicity, the brake has not been shown in the foregoing drawings.

Figure 6:
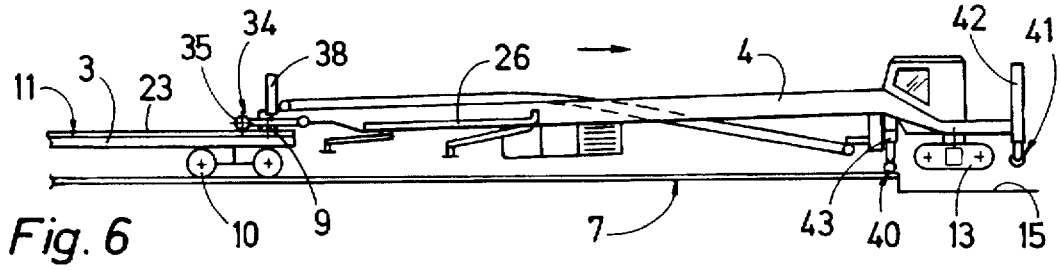

In the next sequence, the auxiliary undercarriage 40 is lowered onto the track 7 while the auxiliary undercarriage 41 is raised into the idle position. Activation of the drive 43 advances the second carrier frame 4 in direction to the job site while the first carrier frame 3 or flatbed car 11 remains stationary, until the off-track undercarriage 13 is disposed above the trackless zone of the ballast bed 15, as shown in FIG. 6. At the same time, the areas of the carrier frames 3, 4 in superimposed disposition are displaced relative to one another until the joint 9 links up the carrier frames 3, 4 i.e. until the opening in the crosspiece 48 of the second carrier frame 4 is in alignment with the vertical post 47 for effecting the jointed connection 6. At this point, the second carrier frame 4 is lowered onto the first carrier frame 3, whereby the pivot drive 38 of the auxiliary undercarriage 34 swings the flanged rollers 35 upwardly relative to the second carrier frame 4.

Figure 7:
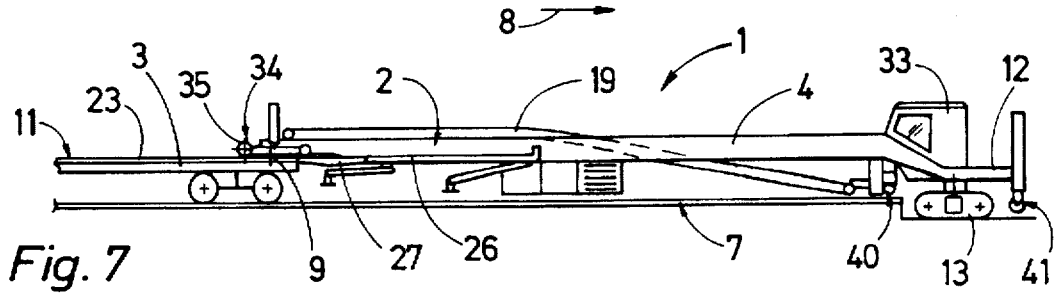

As shown in FIG. 7, the joint-distal end 12 of the second carrier frame 4 is lowered onto the ballast bed 15 during raising of the auxiliary undercarriage 40 and supported on the ballast bed 15 by the off-track undercarriage 13. The railway tracks 23, 26 are connected to one another by the connection pieces 27 to form a continuous track, and the flanged rollers 35 of the auxiliary undercarriage 34 are moved inwardly toward one another in transverse direction of the machine frame 2 into the position shown in dashdot lines in FIG. 2, in order to allow an unobstructed traveling of the mobile crane 18 on the railway, tracks 23, 26. Now, the actual laying operation of the ties 6 and rails 5 onto the ballast bed 15 can commence.

After conclusion of the track laying operation, a loading of the second carrier frame 4 onto the first carrier frame 3 is initiated by disengagement of the joint 9 to separate the carrier frames 3, 4 from one another and lowering of the flanged rollers 35 of the auxiliary undercarriage 34 onto the railway track 23. Subsequently, the further manipulations are executed in reverse order as compared to the sequence for readying the track laying machine 1 for track renewal operation.

While the invention has been illustrated and described as embodied in a machine for laying a railroad track, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A machine for continuously laying a railroad track formed by rails fastened to ties; comprising:

a machine frame having a first carrier frame and a second carrier frame which in operative position are arranged successively in longitudinal direction of the machine frame and supported on undercarriages for mobility on the track in an operating direction;

a disengageable joint for detachably connecting the first and second carrier frames to one another, with the second carrier frame being positioned above the first carrier frame in an area of the joint and movable relative to the first carrier frame in longitudinal direction of the machine frame, said second carrier frame having a joint-distal free end;

an off-track undercarriage provided at the joint-distal free end of the second carrier frame;

a tie transport device for continuously transporting ties in longitudinal direction of the machine frame, said tie transport device including a mobile crane capable of traveling on a railway track formed on the first carrier frame;

an auxiliary undercarriage operatively connected to the second carrier frame in the area of the joint, said auxiliary undercarriage being movable on the railway track of the first carrier frame; and a drive unit for adjusting the auxiliary undercarriage in a vertical direction.

2. The machine of claim 1, and further comprising two additional auxiliary track-bound undercarriages which are vertically adjustable and connected to the second carrier frame, one of the two auxiliary undercarriages being disposed on one side of the off-track undercarriage and the other one of the two auxiliary undercarriages being disposed on the other side of the off-track undercarriage.

3. The machine of claim 2, and further comprising a separate drive for operating at least one of the two auxiliary undercarriages.

4. The machine of claim 1 wherein the drive unit is configured in the form of a pivot drive, said joint-area auxiliary undercarriage being connected to the drive unit and swingably mounted to the second carrier frame about a horizontal axis which extends perpendicular to the longitudinal direction of the machine frame.

5. The machine of claim 1 wherein the second carrier frame has a section extending from the joint and provided with a railway track which forms a prolongation of the railway track of the first carrier frame for traveling of the crane in operative position of the machine frame at a job site.

6. The machine of claim 1 wherein the tie transport device includes a conveyor belt positioned in an area of the second carrier frame in longitudinal direction of the machine frame.

7. The machine of claim 6 wherein the second carrier frame has a section extending from the joint and provided with a railway track which forms a prolongation of the railway track of the first carrier frame for traveling of the crane in operative position of the machine frame at a job site, said conveyor belt being arranged in an area of the railway track of the second carrier frame, for formation of a tie transfer zone, above a horizontal plane defined by the second carrier frame.

8. The machine of claim 6, and further comprising a tie laying device mounted to the second carrier frame in an area of the off-track undercarriage for depositing ties upon a ballast bed, said tie laying device interacting with a leading end of the conveyor belt.

9. The machine of claim 1, and further comprising rail transport means operatively connected to the first and second carrier frames for effecting a continuous transport of rails in longitudinal direction of the machine frame.

10. The machine of claim 1, and further comprising an operator's cab positioned on the joint-distal end of the second carrier frame.

* * * * *